US011111454B2

(12) United States Patent
Gillespie et al.

(10) Patent No.: US 11,111,454 B2
(45) Date of Patent: Sep. 7, 2021

(54) LUBRICANT FORMULATION COMPRISING FRICTION MODIFIER ADDITIVE

(71) Applicant: Croda international PLC, East Yorkshire (GB)

(72) Inventors: David Anthony James Gillespie, East Yorkshire (GB); John Eastwood, East Yorkshire (GB); Gareth Moody, East Yorkshire (GB); Aitziber Viadas Cienfuegos, East Yorkshire (GB)

(73) Assignee: Croda International PLC, East Yorkshire (GB)

( * ) Notice: Subject to any disclaimer, the term of this patent is extended or adjusted under 35 U.S.C. 154(b) by 0 days.

(21) Appl. No.: 16/761,904

(22) PCT Filed: Nov. 2, 2018

(86) PCT No.: PCT/EP2018/080000

§ 371 (c)(1),
(2) Date: May 6, 2020

(87) PCT Pub. No.: WO2019/091868

PCT Pub. Date: May 16, 2019

(65) Prior Publication Data

US 2021/0171857 A1 Jun. 10, 2021

(30) Foreign Application Priority Data

Nov. 9, 2017 (GB) ..... 1718527

(51) Int. Cl.

| | |
|---|---|
| ***C10M 105/38*** | (2006.01) |
| ***C10M 169/04*** | (2006.01) |
| ***C10M 145/22*** | (2006.01) |
| *C10N 40/25* | (2006.01) |
| *C10N 10/12* | (2006.01) |
| *C10N 30/06* | (2006.01) |
| *C10N 40/04* | (2006.01) |

(52) U.S. Cl.

CPC ..... *C10M 169/04* (2013.01); *C10M 145/22* (2013.01); *C10M 2209/102* (2013.01); *C10N 2010/12* (2013.01); *C10N 2030/06* (2013.01); *C10N 2040/04* (2013.01); *C10N 2040/255* (2020.05)

(58) Field of Classification Search

CPC ..... C10M 169/04; C10M 145/22; C10M 2209/102; C10N 2030/06; C10N 2040/04; C10N 2040/255; C10N 2010/12

USPC ..... 508/458

See application file for complete search history.

(56) References Cited

U.S. PATENT DOCUMENTS

| | | | | |
|---|---|---|---|---|
| 4,105,571 | A * | 8/1978 | Shaub | C10M 141/10 508/237 |
| 5,378,249 | A | 1/1995 | Morrison | |
| 5,925,602 | A | 7/1999 | Zehler et al. | |
| 9,267,092 | B2 | 2/2016 | Wilkes | |
| 2008/0096778 | A1 | 4/2008 | Breon et al. | |
| 2016/0222311 | A1* | 8/2016 | Saccomando | C10M 133/56 |

FOREIGN PATENT DOCUMENTS

| | | | |
|---|---|---|---|
| EP | 93598 | A2 | 9/1983 |
| JP | 2015071685 | A1 | 4/2015 |
| JP | 2015095314 | A1 | 4/2015 |
| WO | 2001046350 | A1 | 6/2001 |

OTHER PUBLICATIONS

International Search Report and Written Opinion for PCT/EP2018/080000 dated Jan. 29, 2019.

* cited by examiner

*Primary Examiner* — Prem G Singh
*Assistant Examiner* — Francis C Campanell
(74) *Attorney, Agent, or Firm* — BakerHostetler

(57) ABSTRACT

The invention provides a lubricant formulation comprising: (a) a base oil selected from API Group I to V oils and mixtures thereof; (b) 0.01 to 10 wt % on the basis of the total weight of the lubricant formulation of a friction modifier additive; and (c) other lubricant formulation additives. The friction modifier additive has a hydroxyl value in the range from 10 to 300 mg KOH/g and is the reaction product of reactants comprising: i) a dimer fatty acid; ii) a polyol; iii) optionally, a C2 to C12 dicarboxylic acid or diol; and iv) optionally, a C1 to C10 mono-carboxylic acid or mono-alcohol. The invention also provides a method of lubricating an internal combustion engine comprising a crankcase and a wet clutch and the use of a friction modifier additive.

24 Claims, No Drawings

LUBRICANT FORMULATION COMPRISING FRICTION MODIFIER ADDITIVE

CROSS-REFERENCE TO RELATED APPLICATIONS

This application is the National Stage of International Patent Application No. PCT/PCT2018/080000 filed Nov. 2, 2018, which claims priority from Great Britain Patent Application No. 1718527.3, filed Nov. 9, 2017, the disclosures of each of which are incorporated herein by reference in their entireties for any and all purposes.

FIELD OF INVENTION

The present invention relates to a lubricant formulation, a method of lubricating and the use of a friction modifier additive. The lubricant formulation, method and use may be employed in multiple application areas, specifically in engines. The lubricant formulation and/or friction modifier additive may provide particular advantage in lubricating a vehicle in which the same lubricant formulation is used to lubricate the crankcase of an engine and a clutch. Such a vehicle may be a two-wheeled vehicle, for example a motorcycle, preferably a motorcycle having a four-stroke piston engine.

In particular, the present invention relates to lubricant formulations for motorcycle engines where the lubricant formulation lubricates both a crankcase and a wet clutch and may be supplied from a common lubricant reservoir (or sump).

BACKGROUND

Lubricant formulations for motorcycles typically provide lubrication for both the crankcase of the engine and a wet clutch. This is in contrast to other vehicles (such as passenger cars) in which the crankcase is lubricated by a first lubricant and the clutch is lubricated by a second lubricant of a different formulation. The crankcase and clutch of a motorcycle, although lubricated by the same lubricant formulation, have different lubrication requirements. For example, the lubrication of the crankcase requires low friction (e.g. steel-on-steel friction) to promote good fuel economy. However, the clutch friction required is typically relatively higher, to assure good engagement and power transmission. Additionally, motorcycle lubricants may also lubricate other devices such as gears or bearings, each having their own lubricating requirement. Many lubricant formulations have been designed over the years specifically for lubrication of motorcycles (also known as motorbikes or motorscooters). Because of the varied and demanding lubrication performance required of them, motorcycle lubricant formulations are designed specifically for use in motorcycles. For example, lubricant formulations used in lubricating passenger car engines are generally not suitable for motorcycles. Lubricant formulations for passenger car engines may exhibit too low a coefficient of friction for lubricating the wet clutch found in most motorcycles.

In a typical motorcycle the same lubricant reservoir (or "sump") supplies lubricant to the engine and clutch and may also supply the gears. Therefore the lubricant formulation must perform well in several, seemingly contradictory, environments:

1. Crankcase: the lubricant should reduce frictional losses to improve fuel efficiency/economy and reduce power loss whilst minimizing wear and dissipating heat.

2. Clutch: friction should be high at both low and high speed to ensure efficient torque transfer and quick clutch engagement respectively whilst minimizing wear and dissipating heat.
3. Gears: effective wear protection is important here to increase component lifetime.

The Japanese Automotive Standards Organisation (JASO) has introduced a standard (T903) which rates motorcycle engine oils based on their performance in the standard SAE no. 2 test for clutch friction. The T903 standard classifies clutch friction performance into 3 ratings which are, in order of highest performance to lowest: MA2, MA1 and MB. If an oil has mixed MA2 and MA1 ratings, it is classified as MA. Examples of MA rated motorcycle engine oils are Valvoline 4-Stroke Synthetic Motorcycle Oil 10W-40 and 20W-50 and Mobil 1 Racing 4T 10W-40 and 15W-50 four-stroke motorcycle engine oils. Examples of MB rated oils are Red Line 10W-40 ester based motorcycle oil and Silkolene QUAD ATV 5W-40 Fully Synthetic 4-Stroke Engine Oil.

There exists a need to provide an improved friction modifier additive for a lubricant formulation to meet one or more of the requirements discussed above.

SUMMARY OF THE INVENTION

The present invention is based in part on the recognition by the applicant that certain friction modifier additives can provide a surprising combination of a significant decrease in friction in a crankcase without a similar level of decrease of friction in a clutch. These friction modifier additives comprise a dimer fatty acid and have a hydroxyl value in the range from 10 to 300 mg KOH/g. Without being bound by theory, it has been recognised by the applicant that the properties of a friction modifier additive comprising a hydroxyl functionalised derivative of dimer fatty acid may provide a beneficial reduction in friction in the crankcase of an engine with less detriment to the friction in the clutch when compared with a comparative friction modifier.

Thus viewed from a first aspect the present invention provides a lubricant formulation comprising:

(a) a base oil selected from API Group I to V oils and mixtures thereof;
(b) 0.01 to 10 wt % on the basis of the total weight of the lubricant formulation of a friction modifier additive; and
(c) other lubricant formulation additives;

wherein the friction modifier additive is a hydroxyl functionalised derivative of dimer fatty acid, wherein the friction modifier additive has a hydroxyl value in the range from 10 to 300 mg KOH/g and wherein the friction modifier additive is the reaction product of reactants comprising:

i) a dimer fatty acid;
ii) a polyol selected from ethylene glycol, diethylene glycol, triethylene glycol, polyethylene glycol, propylene glycol, dipropylene glycol, tripropylene glycol polypropylene glycol, butylene glycol, propanediol, butanediol, glycerol and mixtures thereof;
iii) optionally, a C2 to C12 dicarboxylic acid or diol; and
iv) optionally, a C1 to C10 mono-carboxylic acid or mono-alcohol.

Viewed from a second aspect the present invention provides a method of lubricating an internal combustion engine comprising a crankcase and a wet clutch, the method comprising supplying to the crankcase and the wet clutch a lubricant formulation comprising:

(a) a base oil selected from API Group I to V oils and mixtures thereof; and (b) 0.01 to 10 wt % on the basis of the total weight of the lubricant formulation of a friction modifier additive which is a hydroxyl functionalised derivative of dimer fatty acid wherein the friction modifier additive has a hydroxyl value in the range from 10 to 300 mg KOH/g.

Viewed from a third aspect the present invention provides the use of a friction modifier additive which is a hydroxyl functionalised derivative of dimer fatty acid having a hydroxyl value in the range from 10 to 300 mg KOH/g, in a lubricant formulation wherein the lubricant formulation has an overall grade of MA2 as defined by JASO standard T903.

Any aspect of the invention may include any of the features described herein with regard to that aspect of the invention or any other aspects of the invention.

DETAILED DESCRIPTION OF THE INVENTION

It will be understood that any upper or lower quantity or range limit used herein may be independently combined.

It will be understood that, when describing the number of carbon atoms in a substituent group (e.g. 'C1 to C6'), the number refers to the total number of carbon atoms present in the substituent group, including any present in any branched groups. Additionally, when describing the number of carbon atoms in, for example fatty acids, this refers to the total number of carbon atoms including the one at the carboxylic acid, and any present in any branch groups.

Many of the chemicals which may be used in the present invention are obtained from natural sources. Such chemicals typically include a mixture of chemical species due to their natural origin. Due to the presence of such mixtures, various parameters defined herein can be an average value and may be non-integral. For example, the number of hydroxyl groups in a compound can be an average value and may be non-integral.

Lubricant Formulation

The lubricant formulation may be selected from a engine, gear, clutch or transmission lubricant formulation. Preferably the lubricant formulation is an engine lubricant formulation, more preferably a piston engine lubricant formulation, particularly an automotive engine lubrication formulation, especially a motorcycle engine lubricant formulation. The lubricant formulation may not be a metal-working fluid. The lubricant formulation may not be a fuel.

The lubricant formulation may not be an emulsion, for example not a water in oil emulsion or an oil in water emulsion. In one embodiment, the lubricant formulation is non-aqueous. However, it will be appreciated that components of the lubricant formulation may contain small amounts of residual water (moisture) which may therefore be present in the lubricant formulation. The lubricant formulation may comprise less than 5 wt % water based on the total weight of the formulation, preferably less than 2 wt %, more preferably less than 1 wt %, particularly less that 0.5 wt %. The lubricant formulation may be substantially anhydrous, preferably is anhydrous.

The lubricant formulation may have a Society of Automotive Engineers (SAE) viscosity grade of XW-Y. X may be from 0 to 20. Y may be from 20 to 50. In one embodiment X is chosen from 0, 5, 10, 15 or 20, preferably from 10, 15 or 20. In one embodiment Y is chosen from 20, 25, 30, 35, 40, 45 or 50, preferably from 40, 45 or 50.

The lubricant formulation is preferably formulated to lubricate a vehicle engine, preferably a four-stroke piston engine, more preferably a spark-ignition engine, desirably a motorcycle engine. The lubricant formulation is preferably formulated to lubricate the crankcase of the engine as well as the clutch and optionally one or more gears.

A motorcycle engine typically has a higher operating temperature and exerts higher shear forces on its lubricant formulation when compared with a passenger car engine. Therefore a motorcycle lubricant formulation may be formulated to withstand higher temperatures and/or shear forces than a passenger car engine lubricant. For at least these reasons, a lubricant formulation used in lubricating a passenger car engine is unlikely to be suitable for this invention.

The lubricant formulation may comprise at most 0.05 wt % (500 ppm on a weight basis), preferably at most 300 ppm, more preferably at most 100 ppm, particularly at most 50 ppm of molybdenum atoms in total when all molybdenum containing additives in the lubricant formulation are considered. Higher levels of molybdenum containing additives are unsuitable for motorcycle engine oils due to the large friction reducing effect of molybdenum. Preferably the lubricant formulation is free from molybdenum containing additives. The lubricant formulation may comprise at least 10 ppm of molybdenum atoms in total when all molybdenum containing additives in the lubricant formulation are considered.

The lubricant formulation may have a total sulfated ash content of 1.2 wt % or less. The sulfur content of the lubricant formulation may be 1 wt % or less, or 0.8 wt % or less, or 0.5 wt % or less, or 0.3 wt % or less. In one embodiment the sulfur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 0.04 wt to 0.12 wt %. In one embodiment the phosphorus content may be 100 ppm to 1000 ppm, or 200 ppm to 600 ppm. The total sulfated ash content may be 0.3 wt % to 1.2 wt %, or 0.5 wt % to 1.1 wt % of the lubricant formulation. In one embodiment the sulfated ash content may be 0.5 wt % to 1.1 wt % of the lubricant formulation.

The lubricant formulation may be classified as a motorcycle lubricant by JASO (Japanese Automotive Standards Organization).

Preferably the lubricant formulation has an overall grade of MA, MA1 or MA2 as defined by JASO standard T903, more preferably T903:2016.

Preferably the lubricant formulation has an overall grade of MA2 as defined by JASO standard T903, more preferably T903:2016.

The lubricant formulation may comprise an additive pack suitable for its intended use, preferably a motorcycle oil additive pack.

(a) Base Oil

The lubricant formulation comprises an oil of lubricating viscosity (also referred to as "base stock" or "base oil") which is the primary liquid constituent of the lubricant formulation. Additives are blended into the base oil, individually or as additive packages, to produce the final lubricant formulation. A base oil is useful for making concentrates as well as for making lubricant formulations, and may be selected from natural (vegetable, animal or mineral) and synthetic lubricating oils and mixtures thereof.

The base oil may comprise natural or synthetic oils of lubricating viscosity; oil derived from hydrocracking, hydrogenation or hydrofinishing; and unrefined, refined and re-refined oils, and mixtures thereof.

Natural oils include animal oils, vegetable oils, mineral oils and mixtures thereof. Synthetic oils include hydrocarbon oils, silicon-based oils, and liquid esters of phosphorus-containing acids. Synthetic oils may be produced by Fischer-Tropsch gas-to-liquid synthetic procedure as well as other gas-to-liquid oils. In one embodiment the polymer composition of the present invention is useful when employed in a gas-to-liquid oil. Often Fischer-Tropsch hydrocarbons or waxes may be hydroisomerised.

In one embodiment the base oil comprises a polyalphaolefin (PAO) selected from PAO-2, PAO-4, PAO-5, PAO-6, PAO-7, PAO-8 and mixtures thereof (the numerical value relating to Kinematic Viscosity at 100° C.). The PAO may not be a PAO-20 or PAO-30 oil, the reason being that a polyalphaolefin with a viscosity higher than a PAO-20 is typically too viscous for effective lubrication of an internal combustion engine.

Base oil groups are defined in the American Petroleum Institute (API) publication "Engine Oil Licensing and Certification System", Industry Services Department, Fourteenth Edition, December 1996, Addendum 1, December 1998. Definitions for the base stocks or base oils in this invention are the same as those found in this API publication. The API categorizes base oils as follows:

a) Group I base oils contain less than 90 percent saturates and/or greater than 0.03 percent sulphur and have a viscosity index greater than or equal to 80 and less than 120.
b) Group II base oils contain greater than or equal to 90 percent saturates and less than or equal to 0.03 percent sulphur and have a viscosity index greater than or equal to 80 and less than 120.
c) Group III base oils contain greater than or equal to 90 percent saturates and less than or equal to 0.03 percent sulphur and have a viscosity index greater than or equal to 120.
d) Group IV base oils are polyalphaolefins (PAO).
e) Group V base oils include all other base stocks not included in Group I, II, III, or IV.

The lubricant formulation of the invention comprises a base oil selected from API Group I, II, III, IV and V oils and mixtures thereof.

The lubricant formulation may comprise no more than 40 wt % Group I base oil, preferably no more than 30 wt %, particularly no more than 20 wt %, desirably no more than 10 wt %, especially no more than 5 wt %. The lubricant formulation may not comprise a Group I base oil. The lubricant formulation may comprise at least 1 wt % Group I base oil.

The lubricant formulation may comprise no more than 85 wt % Group IV base oil, preferably no more than 70 wt %, particularly no more than 50 wt %. The lubricant formulation may not comprise a Group IV base oil. The lubricant formulation may comprise at least 1 wt %, preferably at least 5 wt %, particularly at least 10 wt % Group IV base oil.

The lubricant formulation may comprise at most 99 wt % of the base oil, on the basis of the total weight of the lubricant formulation, preferably at most 97 wt %, more preferably at most 95 wt %, particularly at most 90 wt %. Examples of suitable amounts of base oil include at least 50 wt %, 55 wt %, 60 wt %, 65 wt %, 70 wt %, 75 wt % or 80 wt % of the lubricant formulation, on the basis of the total weight of the lubricant formulation. The lubricant formulation may comprise a balance of base oil (e.g. the base oil may make the lubricant formulation up to 100 wt % after all additives have been included).

(b) Friction Modifier Additive of the Invention

The lubricant formulation comprises 0.01 to 10 wt % of the friction modifier additive on the basis of the total weight of the lubricant formulation. Preferably the lubricant formulation comprises at least 0.01 wt %, more preferably at least 0.02 wt %, particularly at least 0.05 wt %, desirably at least 0.1 wt % of the friction modifier additive on the basis of the total weight of the lubricant formulation. Preferably the lubricant formulation comprises at most 10 wt %, more preferably at most 8 wt %, particularly at most 6 wt %, desirably at most 4 wt %, especially at most 2 wt % of the friction modifier additive on the basis of the total weight of the lubricant formulation. Preferably the lubricant formulation comprises from 0.1 to 6 wt % of the friction modifier additive, on the basis of the total weight of the lubricant formulation.

The friction modifier additive is a hydroxyl functionalised derivative of dimer fatty acid. It will be understood herein that a hydroxyl functionalised derivative means the result of processing or reacting the dimer fatty acid so that the resulting derivative has some hydroxyl functionality e.g. a hydroxyl value in the range from 10 to 300 mg KOH/g.

The term dimer fatty acid is well known in the art and refers to the dimerisation product of mono- or polyunsaturated fatty acids and/or esters thereof. Preferred dimer fatty acids are dimerisation products of C10 to C30, more preferably C12 to C24, particularly C14 to C22, and especially C18 fatty acids. Suitable dimer fatty acids include the dimerisation products of oleic acid, linoleic acid, linolenic acid, palmitoleic acid, erucic acid and elaidic acid with oleic acid being particularly preferred. The dimerisation products of the unsaturated fatty acid mixtures obtained in the hydrolysis of natural fats and oils, e.g. sunflower oil, soybean oil, olive oil, rapeseed oil, cottonseed oil and tall oil, may also be used. Hydrogenated, for example by using a nickel catalyst, dimer fatty acids may also be employed. Unsaturated (e.g. non-hydrogenated) dimer fatty acids are preferred in the present invention.

In addition to the dimer fatty acids, dimerisation usually results in varying amounts of oligomeric fatty acids (so-called "trimer") and residues of monomeric fatty acids (so-called "monomer"), or esters thereof, being present. The amount of monomer can, for example, be reduced by distillation. Particularly preferred dimer fatty acids used in the present invention, have a dimer content of greater than 50%, more preferably greater than 70%, particularly greater than 85%, and especially greater than 94% by weight. The trimer content is preferably less than 50%, more preferably in the range from 1 to 20%, particularly 2 to 10%, and especially 3 to 6% by weight. The monomer content is preferably less than 5%, more preferably in the range from 0.1 to 3%, particularly 0.3 to 2%, and especially 0.5 to 1% by weight.

The dimer fatty acid may be hydroxyl functionalised by one or more of: conversion to a dimer diol, reaction with an alkylene oxide or reaction with reactants comprising a polyol. Preferably the dimer fatty acid is hydroxyl functionalised by reaction with an alkylene oxide or reaction with reactants comprising a polyol, more preferably by reaction with reactants comprising a polyol. The polyol may be reactant ii) of the friction modifier additive as described herein. The alkylene oxide may be ethylene oxide, propylene oxide, butylene oxide or mixtures thereof, preferably ethylene oxide, propylene oxide or mixtures thereof.

The friction modifier additive may comprise on average at least 1 free hydroxyl group, preferably at least 1.5, more preferably at least 1.8. The friction modifier additive may comprise on average at most 4 free hydroxyl groups, preferably at most 3, more preferably at most 2.5.

Preferably the friction modifier additive is the reaction product of reactants comprising:

i) a dimer fatty acid;

ii) a polyol selected from ethylene glycol, diethylene glycol, triethylene glycol, polyethylene glycol, propylene glycol, dipropylene glycol, tripropylene glycol polypropylene glycol, glycerol and mixtures thereof;

iii) optionally, a C2 to C12 dicarboxylic acid or diol; and iv) optionally, a C1 to C10 mono-carboxylic acid or mono-alcohol.

Preferably reactant ii) of the friction modifier additive is a polyol selected from ethylene glycol, diethylene glycol, triethylene glycol, propylene glycol, dipropylene glycol, tripropylene glycol and mixtures thereof, more preferably selected from ethylene glycol, diethylene glycol, triethylene glycol and mixtures thereof, particularly selected from ethylene glycol, diethylene glycol and mixtures thereof.

The weight ratio of reactant i) to reactant ii) in the friction modifier additive may be from 8:1 to 1:8, preferably from 7:1 to 1:7, more preferably from 6:1 to 1:6, particularly from 5:1 to 1:5. The weight ratio of reactant i) to reactant ii) in the friction modifier additive may be at least 1:1, preferably at least 1.5:1, more preferably at least 2:1. The weight ratio of reactant i) to reactant ii) in the friction modifier additive may be at most 6:1, preferably at most 5:1, more preferably at most 4:1.

Preferably the friction modifier additive is the reaction product of solely:

i) a dimer fatty acid; and ii) a polyol selected from ethylene glycol, diethylene glycol, triethylene glycol, propylene glycol, dipropylene glycol, tripropylene glycol and mixtures thereof.

The friction modifier additive may comprise reactant iii) a C2 to C12 dicarboxylic acid or diol, preferably iii) a C2 to C12 dicarboxylic acid, more preferably iii) a C2 to C12 aliphatic dicarboxylic acid, particularly iii) a C4 to C10 aliphatic dicarboxylic acid. For example, reactant iii) may comprise or consist of adipic acid.

The weight ratio of reactant i) to reactant iii) in the friction modifier additive may be from 10:1 to 1:10, more preferably from 6:1 to 1:6.

The friction modifier additive may comprise reactant iv) a C1 to C10 mono-carboxylic acid or mono-alcohol, preferably iv) a C1 to C10 aliphatic mono-alcohol, more preferably iv) a linear or branched C1 to C10 mono-alcohol, particularly iv) a C6 to C10 linear or branched mono-alcohol. For example, reactant iv) may comprise or consist of ethyl hexanol.

The weight ratio of reactant i) to reactant iv) in the friction modifier additive may be from 4:1 to 1:4, more preferably from 2:1 to 1:2.

The friction modifier additive preferably has an acid value (measured using ASTM D1980-87) of at most 20 mg KOH/g, more preferably at most 10 mg KOH/g, particularly at most 5 mg KOH/g, and especially at most 2.5 mg KOH/g. The friction modifier additive may have an acid value (measured as described herein) of at least 0.01 mg KOH/g, preferably at least 0.05 mg KOH/g, particularly at least 0.1 mg KOH/g.

The friction modifier additive of the invention has a hydroxyl value (measured using ASTM D1957-86) in the range from 10 to 300 mg KOH/g. Without being bound by theory, it is believed that this hydroxyl range advantageously provides beneficial frictional effects in both the clutch and the crankcase of an engine. The friction modifier additive preferably has a hydroxyl value of at most 250 mg KOH/g, more preferably at most 180 mg KOH/g, particularly at most 160 mg KOH/g, desirably at most 140 mg KOH/g. The friction modifier additive preferably has a hydroxyl value of at least 15 mg KOH/g, more preferably at least 30 mg KOH/g, particularly at least 60 mg KOH/g, desirably at least 90 mg KOH/g.

The friction modifier additive preferably has an iodine value (measured using ASTM D1959-85) of at least 10 gl/100 g, more preferably at least 20 gl/100 g, particularly at least 50 gl/100 g. The friction modifier additive may have an iodine value of at most 200 gl/100 g, preferably at most 150 gl/100 g. The use of unsaturated dimer fatty acid may contribute to the iodine value of the friction modifier additive.

The friction modifier additive preferably has a kinematic viscosity measured at 25° C. (for example using an Anton Paar Viscometer SVM 3000) of at least 500 mPa·s, more preferably at least 750 mPa·s, particularly at least 1000 mPa·s. The friction modifier additive may have a kinematic viscosity measured at 25° C. of at most 50,000 mPa·s, preferably at most 20,000 mPa·s, more preferably at most 10,000 mPa·s.

The friction modifier additive preferably has a kinematic viscosity measured at 40° C. (for example using an Anton Paar Viscometer SVM 3000) of at least 500 mPa·s, more preferably at least 750 mPa·s, particularly at least 1000 mPa·s. The friction modifier additive may have a kinematic viscosity measured at 40° C. of at most 50,000 mPa·s, preferably at most 20,000 mPa·s, more preferably at most 10,000 mPa·s, particularly at most 6000 mPa·s, desirably at most 4000 mPa·s.

(c) Other Lubricant Formulation Additives

Lubricant formulation additives may be incorporated into the lubricant formulation as part of an additive pack or individually. The friction modifier additive may be incorporated into the lubricant formulation as part of an additive pack or individually. The lubricant formulation may comprise an additive pack. The additive pack may be a motorcycle oil additive pack, preferably a 4-stroke motorcycle oil additive pack. Preferably, the lubricant formulation comprises (c) other lubricant formulation additives as part of a motorcycle oil additive pack.

Representative amounts of other lubricant formulation additives (apart from the friction modifier additive of the Invention) in the lubricant formulation are as follows. Wt % ranges are given on the basis of the total weight of the lubricant formulation. Any combination of these additives and their broad and preferred wt % ranges may be incorporated in the present invention.

| Additive | (Broad) Wt. % | (Preferred) Wt. % |
|---|---|---|
| VI Improvers | 1-12 | 1-8 |
| Corrosion Inhibitors | 0.01-3 | 0.02-1 |
| Dispersants | 0.10-10 | 2-5 |
| Anti-oxidants | 0.01-6 | 0.01-3 |
| Anti-foaming Agents | 0.001-5 | 0.001-0.5 |
| Detergents | 0.01-6 | 0.01-3 |
| Anti-wear Agents | 0.001-5 | 0.2-3 |
| Pour Point Depressants | 0.01-2 | 0.01-1.5 |
| Seal Swellants | 0.1-8 | 0.5-5 |
| Base Oil | Balance | Balance |

1. Viscosity Index (VI) improvers may comprise one or more of: polymethacrylate polymers, ethylene-propylene copolymers, styrene-isoprene copolymers, hydrogenated styrene-isoprene copolymers, polyisobutylene, and dispersant type viscosity index improvers.

2. Corrosion inhibitors may comprise one or more of: derivatives of benzotriazoles (typically tolyltriazole), 1,2,4-triazoles, benzimidazoles, 2-alkyldithiobenzimidazoles or 2-alkyldithiobenzothiazoles or sarcosine derivatives, for example Crodasinic O available from Croda Europe Ltd:

3. Dispersants may comprise one or more of: alkenyl succinimides, alkenyl succinate esters, alkenyl succinimides modified with other organic compounds, alkenyl succinimides modified by post-treatment with ethylene carbonate or boric acid, pentaerythritols, phenate-salicylates and their post-treated analogs, alkali metal or alkaline earth metal borates, dispersions of hydrated alkali metal borates, dispersions of alkaline-earth metal borates, polyamide ashless dispersants, Mannich condensation products of hydrocarbyl substituted phenols, formaldehyde and polyamines. Mixtures of dispersants may also be used.

4. Anti-oxidants may comprise one or more of: phenol type (phenolic) oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butyl-phenol), 4,4'-butylidene-bis(3-methyl-6-tert-butylphenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-methylene-bis(4-methyl-6-cyclohexylphenol), 2,6-di-tert-butyl-4-methylphenol, 2,6-di-tert-butyl-4-ethylphenol, 2,6-di-tert-butylphenol, 2,4-dimethyl-6-tert-butyl-phenol, 2,6-di-tert-1-dimethylamino-p-cresol, 2,6-di-tert-4-(N,N'-dimethylamino-methylphenol), 4,4'-thiobis(2-methyl-6-tert-butylphenol), 2,2'-thiobis(4-methyl-6-tert-butylphenol), bis(3-methyl-4-hydroxy-5-tert~butylbenzyl)-sulfide, and bis(3,5-di-tert-butyl-4-hydroxybenzyl). Anti-oxidants may also comprise one or more of alkylated diphenylamines (e.g., Irganox L-57 from BASF), metal dithiocarbamate (e.g., zinc dithiocarbamate), methylene-bis(dibutyldithiocarbamate), Irganox L-107 or L-109.

5. Anti-foaming agents may comprise one or more of: (meth)acrylate polymers, alkyl-(meth)acrylate polymers, silicone polymers and dimethyl silicone polymers.

6. Detergents may comprise one or more of: oil-soluble neutral or overbased salts of alkali or alkaline earth metals with one or more of the following acidic substances (or mixtures thereof: (1) sulfonic acids, (2) carboxylic acids, (3) salicylic acids, (4) alkyl phenols, (5) sulfurized alkyl phenols, (6) organic phosphorus acids characterized by at least one direct carbon-to-phosphorus linkage. Such organic phosphorus acids include those prepared by the treatment of an olefin polymer (e.g., polyisobutylene having a molecular weight of 1,000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The preferred salts of such acids from the cost-effectiveness, toxicological, and environmental standpoints are the salts of sodium, potassium, lithium, calcium and magnesium. The preferred salts useful with this invention are either neutral or overbased salts of calcium or magnesium. Oil-soluble neutral metal-containing detergents are those detergents that contain stoichiometrically equivalent amounts of metal in relation to the amount of acidic moieties present in the detergent. Thus, in general the neutral detergents will have a low basicity when compared to their overbased counterparts. The acidic materials utilized in forming such detergents include carboxylic acids, salicylic acids, alkylphenols, sulfonic acids, sulfurized alkylphenols and the like. The term "overbased" in connection with metallic detergents is used to designate metal salts wherein the metal is present in stoichiometrically larger amounts than the organic radical. The commonly employed methods for preparing the overbased salts involve heating a mineral oil solution of an acid with a stoichiometric excess of a metal neutralizing agent such as the metal oxide, hydroxide, carbonate, bicarbonate, of sulfide at a temperature of about 50° C., and filtering the resultant product. The use of a "promoter" in the neutralization step to aid the incorporation of a large excess of metal likewise is known. Examples of compounds useful as the promoter include phenolic substances such as phenol, naphthol, alkyl phenol, thiophenol, sulfurized alkylphenol, and condensation products of formaldehyde with a phenolic substance; alcohols such as methanol, 2-propanol, octanol, Cellosolve alcohol, Carbitol alcohol, ethylene glycol, stearyl alcohol, and cyclohexyl alcohol; and amines such as aniline, phenylene diamine, phenothiazine, phenyl-beta-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60° to 200° C. In summary, the detergents may be neutral, basic or overbased alkali metal or alkaline earth metal-containing organic acid salts.

7. Anti-wear agents may comprise one or more of: phosphates, phosphites, carbamates, esters, sulfur containing compounds, and molybdenum complexes. Preferred are phosphorus-containing anti-wear/extreme pressure agents comprise metal thiophosphates, phosphoric acid esters and salts thereof, phosphorus-containing carboxylic acids, esters, ethers, and amides; and phosphites. In certain embodiments a phosphorus anti-wear agent may be present in an amount to deliver 0.01 to 0.2 or 0.015 to 0.15 or 0.02 to 0.1 or 0.025 to 0.08 weight percent phosphorus in the total lubricant formulation. A preferred anti-wear agent is a zinc dialkyldithiophosphate (primary alkyl, secondary alkyl, and/or aryl type). Non-phosphorus-containing anti-wear agents include borate esters (including borated epoxides), dithiocarbamate compounds, molybdenum-containing compounds, and sulfurized olefins.

8. Pour point depressants may comprise one or more of: polyalphaolefins, esters of maleic anhydride-styrene copolymers, poly(meth)acrylates, or polyacrylamides.

9. Seal swellants may comprise one or more of: esters, amides or sulfolene derivatives. Examples of seal swellants include Exxon Necton-37™ (FN 1380) and Exxon Mineral Seal Oil™ (FN 3200).

The lubricant formulation may comprise one or more multifunctional additives, for example: molybdenum dithiocarbamate, sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound. However, as discussed above, it is preferred that the lubricant formulation comprises at most 500 ppm by weight of molybdenum.

Method of Lubricating an Internal Combustion Engine

The invention provides a method of lubricating an internal combustion engine comprising a crankcase and a wet clutch, the method comprising supplying to the crankcase and the wet clutch a lubricant formulation comprising:

(a) a base oil selected from API Group I to V oils and mixtures thereof; and (b) 0.01 to 10 wt % on the basis of the total weight of the lubricant formulation of a friction modifier additive which is a hydroxyl functionalised derivative of dimer fatty acid wherein the friction modifier additive has a hydroxyl value in the range from 10 to 300 mg KOH/g.

As used herein the term "wet clutch" is known to a person skilled in the art and means a clutch comprising one or more clutch plates to which is supplied a (liquid) lubricant formulation.

The (wet) clutch may comprise one or more metal (e.g. steel) plates interleaved with one or more plates made of another material (e.g. friction material). The selection of clutch plate material may be designed to provide a high sliding coefficient of friction. The assembly of friction material and metal plates is termed a clutch "pack". The friction plate(s) may comprise i) organic friction materials, for example, cellulose fibers, fiberglass, Kevlar (para-aramid fiber), or mineral wool encased in a thermosetting phenolic resin base; ii) semi-metallic friction materials, which may contain brass, copper, or other metal wire in a thermosetting phenolic resin base; iii) sintered metal friction materials, which are made by sintering powdered metals such as copper, bronze, or iron; or iv) carbon fiber based friction materials.

The engine, preferably motorcycle engine, may have a single common oil/lubricant reservoir (or "sump") supplying the same lubricant formulation to the crankcase and at least one of a gear and a wet-clutch. In certain embodiments the lubricating formulation is supplied to the crankcase and to the gear (or multiplicity of gears), or to the crankcase and the wet clutch, or to the crankcase and both the gear (or gears) and the wet clutch. Preferably the lubricant formulation is further supplied to a gear. Preferably the lubricant formulation is supplied from a single lubricant reservoir.

The engine may be a 4-stroke (piston) engine. The engine may be a spark-ignition engine. In one embodiment the engine has a capacity of up to 3500 $cm^3$ displacement, preferably up to 2500 $cm^3$ displacement, more preferably up to 2000 $cm^3$ displacement. Examples of suitable engines with a capacity up to 3500 $cm^3$ displacement include motorcycle, snowmobile, jet-ski, quad-bike, or all-terrain vehicle engines. Preferably the engine is a motorcycle engine, for example a 4-stroke motorcycle engine. Preferably the engine is not a passenger car (or larger vehicle) engine.

Preferably the friction modifier additive is a friction modifier additive as described herein.

Preferably the lubricant formulation is a lubricant formulation as described herein.

Use of the Friction Modifier Additive

The invention provides the use of a friction modifier additive which is a hydroxyl functionalised derivative of dimer fatty acid having a hydroxyl value in the range from 10 to 300 mg KOH/g, in a lubricant formulation wherein the lubricant formulation has an overall grade of MA2 as defined by JASO standard T903. Preferably the invention provides the use of a friction modifier additive which is a hydroxyl functionalised derivative of dimer fatty acid having a hydroxyl value in the range from 10 to 300 mg KOH/g, in a lubricant formulation to reduce friction in the crankcase of an internal combustion engine.

Preferably the friction modifier additive is a friction modifier additive as described herein.

Preferably the lubricant formulation is a lubricant formulation as described herein.

Beneficial Effects of the Friction Modifier Additive

In any aspect of the invention, the friction modifier additive may provide one or more beneficial effects.

The friction modifier additive may reduce the dynamic coefficient of friction (DCF), measured by MTM, preferably measured according to MTM Test 1 as described herein, when compared with a control sample of the lubricant formulation without the friction modifier. The dynamic coefficient of friction may be reduced over a range of speeds from 0.005 $ms^{-1}$ to 3 $ms^{-1}$. The friction modifier additive may reduce the DCF by at least 10%, preferably by at least 20% at speeds of 0.005 $ms^{-1}$, 0.05 $ms^{-1}$, 0.5 $ms^{-1}$ and/or 3 $ms^{-1}$. To achieve this effect the friction modifier additive may be added at 0.1 to 2 wt % on the basis of the total weight of the lubricant formulation, preferably at 0.5 to 1 wt %.

The friction modifier additive may reduce the static friction index (SFI), measured according to the JASO T903: 2016 standard (using an SAE no. 2 machine) as described herein, by less than 35%, preferably by less than 32%, more preferably by less than 25%, particularly by less than 20%, when compared with a control sample of the lubricant formulation without the friction modifier. To achieve this effect the friction modifier additive may be added at 0.1 to 2 wt % on the basis of the total weight of the lubricant formulation, preferably at 0.5 to 1 wt %.

Any or all of the features described herein, and/or any or all of the steps of any method or process described herein, may be used in any combination in any aspect of the invention.

EXAMPLES

The invention is illustrated by the following non-limiting examples. It will be understood that all tests and physical parameters described herein have been determined at atmospheric pressure and room temperature (i.e. about 20° C.), unless otherwise stated herein, or unless otherwise stated in the referenced test methods and procedures. All parts and percentages are given by weight of the total lubricant formulation unless otherwise stated.

Test Methods

All tests herein use a fully formulated motorcycle engine oil which is Motul 4T 5100 15W50 MA2. The engine oil is available ex Motul and its JASO oil code is M065MOT048.

i) Acid Value

Acid value was determined by using ASTM D1980-87 (Standard test method for acid value of fatty acids and polymerised fatty acids).

ii) Hydroxyl Value

Hydroxyl value was measured by using ASTM D1957-86 (Standard test method for hydroxyl value of fatty oils and acids).

iii) Iodine Value

Iodine value was measured by using ASTM D1959-85.

iv) Kinematic Viscosity

Kinematic Viscosity was measured using an Anton Paar Viscometer SVM 3000 series.

v) MTM Tests

The coefficient of friction was measured using a Mini-Traction Machine (MTM). The MTM was supplied by PCS instruments of London, UK. This machine provides a method for measuring the coefficient of friction of a given lubricant in a given tribological contact. Various system properties such as speed, load, and temperature can be varied. The MTM is a computer controlled precision traction measurement system whose test specimens and configuration have been designed such that realistic pressures, temperatures and speeds can be attained without requiring large loads, motors, or support structures.

MTM Test 1—Crankcase Simulation—Rolling-Sliding Friction Test

MTM test 1 is a crankcase simulation which tests rolling-sliding friction. The disc and ball were both polished AISI 52100 hardened bearing steel (Ra<0.01 μm). The applied load was 36N (1 GPa contact pressure) the speed of rotation was varied from 0.005 $ms^{-1}$ to 3 $ms^{-1}$. Approximately 50 ml of the candidate lubricant was added and tested at 135° C. The ball was loaded against the face of the disc and the ball and disc were driven independently to create a mixed rolling/sliding contact with a slide/roll ratio of 50%. The frictional force was measured using a force transducer, from this the dynamic coefficient of friction (DCF) was calculated. Additional sensors measured the applied load and lubricant temperature.

MTM Test 2—Clutch Simulation—Pure Sliding Ball on Disc Test

MTM test 2 simulates a wet clutch environment using a smooth steel ball on a disc coated with a friction material. Approximately 50 ml of the candidate lubricant is used for the test which is conducted at 100° C. The test is designed to mimic the conditions found in the SAE no. 2 test rig during a friction test according to the JASO T903 standard. It therefore consists of a number of cycles of acceleration, deceleration, and low speed constant velocity sliding, as shown in Table 1. Each cycle consists of one Dynamic co-efficient of friction (DCF) test and one Static co-efficient of friction (SCF) test as defined in Table 1. By running multiple cycles the system is allowed to run in and stable, repeatable results are obtained.

TABLE 1

| MTM Test 2—clutch simulation—mimic SAE no. 2 test | |
|---|---|
| Parameter | Value |
| Load | 3N |
| Contact type | Ball on disc (pure sliding) |
| Temperature | 100° C. |
| Dynamic co-efficient of friction (DCF) test steps | 1) Speed up: 0.01-3.5 $ms^{-1}$ (60 s)<br>2) Speed down: 3.5-0.1 $ms^{-1}$ (60 s) |
| Static co-efficient of friction (SCF) test step | 1) 0.004 $ms^{-1}$ (10 s) |
| Test specimens | Upper: Polished AISI 52100 bearing steel ball (Ra <0.01 μm)<br>Lower: Friction material coated disc |

In this test the upper specimen was a polished AISI 52100 hardened bearing steel ball and the lower specimen was a steel disc coated with a phenolic resin and cellulose fibre based friction material. This type of friction material is usually referred to as an organic or organic composite material. Many other materials can be used for the friction material portion of the clutch, including, but not limited to: amorphous carbon based materials; sintered metal or ceramic materials; and para-aramid fibre based materials (e.g. Kevlar).

vi) SAE No. 2 Testing According to Standard JASO T903:2016

The JASO standard T903:2016 (where 2016 is the date of the current latest revision) specifies a test for four stroke gasoline engine oils intended for use in a four stroke motorcycle where a common lubricant is used for the engine, clutch, and gears. The T903 standard uses coefficient of friction measurements from the SAE no. 2 clutch friction test machine (or equivalent instrument) used according to JASO standard M348:2012 (where 2012 is the date of the current latest revision). The T903 standard utilizes a clutch pack consisting of several steel disks and fiber plates enclosed in a test head. The clutch pack operates in a temperature controlled oil bath. An electric motor is then used to rotate the fiber plates to 3,600 RPM while the steel disks are held static in the test head. During this motoring phase, there is no pressure applied to the clutch pack. Once speed and temperature set points are met, pressure is then applied to the clutch pack to cause lock up. This event is referred to as a dynamic engagement. A metal disc connected to the electric motor simulates vehicle inertia. During this dynamic engagement, parameters such as speed and torque are measured and are used to calculate the Dynamic Friction Index (DFI) and Stop Time Index (STI). These are the first two parameters which are used to classify an engine oil's frictional performance. The third parameter is called the Static Friction Index (SFI). For this evaluation, the same test rig is used, but now the evaluation begins with the pressure applied to the clutch to facilitate lock up. A low speed, high torque motor is used to 'break' the clutch pack loose and cause slippage. Once again, torque, speed, and other parameters are measured and used to calculate SFI. The values of these three friction indices (DFI, STI, SFI) determine the JASO classification of the candidate lubricant formulation.

Example 1

Friction Modifiers A, B and C were synthesised using the raw materials given in Table 2 below, with amounts in grams.

TABLE 2

| Reactant | Friction Modifier A (g) | Friction Modifier B (g) | Friction Modifier C (g) |
|---|---|---|---|
| Adipic acid | 400 | 425 | |
| Propylene glycol | 230 | 295 | |
| Ethylene glycol | | | 195 |
| 2-Ethyl hexanol | 65 | | |
| Dimer fatty acid * | 49 | 106 | 555 |

* PRIPOL 1013 dimer fatty acid ex Croda.

The synthesis procedure was as follows. To a 1 liter round bottomed flask reactor equipped with nitrogen inlet and stirrer, thermocouple, column with condenser and set up to allow the removal of reaction distillate, all ingredients were charged. The mixture was heated slowly to the reaction temperature of 225° C. and reaction water was distilled off. Heating was controlled to ensure the top temperature of the column did not exceed 105° C. The reaction progress was monitored by acid value. Once acid value of 30 mg KOH/g was reached, mild vacuum was applied. The reaction was continued until acid value was 6 mg KOH/g. Then the vacuum was deepened and the reaction was continued until the specifications given in Table 3 were reached for the products. Kinematic viscosity was measured using an Anton Paar Viscometer SVM 3000. The products will be called Friction Modifier A, B and C.

TABLE 3

| Parameter | Friction Modifier A | Friction Modifier B | Friction Modifier C |
|---|---|---|---|
| Acid value (mg KOH/g) | Max 2 | Max 2 | Max 1.4 |
| OH value (mg KOH/g) | Max 20 | 23-33 | Max 120 |

TABLE 3-continued

| Parameter | Friction Modifier A | Friction Modifier B | Friction Modifier C |
|---|---|---|---|
| Kinematic Viscosity at 25° C. (mPa · s) | 4250-4950 | 35000-45000 | |
| Kinematic Viscosity at 40° C. (mPa · s) | | | 800-1600 |

Example 2

Samples 1 to 5 were prepared from Motul 4T 5100 15W50 MA2 which is a fully formulated commercial 15W50 JASO MA2 motorcycle engine oil. The Friction Modifier additive being tested is top treated into the engine oil at 1 wt % of the total lubricant formulation for Samples 2, 3 and 5 and at 0.5 wt % for Sample 4 as shown in Table 4.

TABLE 4

| Sample | Friction Modifier additive |
|---|---|
| 1-control | none |
| 2 | Friction Modifier A @ 1 wt % of total formulation |
| 3 | Friction Modifier B @ 1 wt % of total formulation |
| 4 | Friction Modifier C @ 0.5 wt % of total formulation |
| 5-comparative | glycerol monoisostearate (GMIS) @ 1 wt % of total formulation |

Example 3

Samples 1 to 5 were tested by MTM Test 1 as described above. The results for dynamic coefficient of friction (DCF) are given in Table 5.

TABLE 5

Results of MTM Test 1 - crankcase simulation

| | 0.005 $ms^{-1}$ | | 0.05 $ms^{-1}$ | | 0.5 $ms^{-1}$ | | 3 $ms^{-1}$ | |
|---|---|---|---|---|---|---|---|---|
| Sample | DCF | % DCF decrease | DCF | % DCF decrease | DCF | % DCF decrease | DCF | % DCF decrease |
| 1 - control | 0.131 | N/A | 0.131 | N/A | 0.106 | N/A | 0.038 | N/A |
| 2 | 0.060 | 54 | 0.091 | 31 | 0.063 | 41 | 0.027 | 29 |
| 3 | 0.071 | 46 | 0.090 | 31 | 0.061 | 42 | 0.024 | 37 |
| 4 | 0.085 | 35 | 0.084 | 36 | 0.058 | 45 | 0.025 | 34 |
| 5 - comp | 0.099 | 24 | 0.092 | 30 | 0.054 | 49 | 0.027 | 29 |

It can be seen from Table 5 that inventive Samples 2, 3 & 4 have an improved decrease in dynamic coefficient of friction (DCF) at low speed (0.005 $ms^{-1}$) when compared with glycerol monoisostearate (GMIS) which is the Friction Modifier additive of comparative Sample 5. At the higher speeds, the decrease in friction for all of Samples 2 to 5 is significant when compared with control Sample 1. A decrease in friction in the crankcase is desirable for various reasons including fuel efficiency.

Example 4

Samples 1 to 5 were tested by MTM Test 2 as described above. The results for static co-efficient of friction (SCF), as defined in Table 1, are given in Table 6.

TABLE 6

Results of MTM Test 2—clutch simulation

| Sample | SCF | % SCF increase |
|---|---|---|
| 1-control | 0.145 | N/A |
| 2 | 0.180 | 24 |
| 3 | 0.177 | 22 |
| 4 | 0.147 | 1 |
| 5-comp | 0.098 | (32)* |

*parentheses () indicate a negative value i.e. a decrease

It can be seen from Table 6 that inventive Samples 2 & 3 have a significant increase in SCF when compared with control Sample 1. Inventive Sample 4 shows a slight increase in SCF. In contrast, the glycerol monoisostearate (GMIS) of comparative Sample 5 significantly reduces the SCF measurement by over 30% in this clutch simulation. Such a significant reduction in SCF in comparative Sample 5 is undesirable since it may reduce the friction in a clutch to such an extent that the likelihood of the clutch slipping is increased.

Example 5

Samples 1 to 5 were tested according to the JASO T903:2016 standard measured using an SAE no. 2 friction test machine as described in the test methods above. Static friction index (SFI) was calculated according to the JASO T903 standard. The results are given in Table 7.

TABLE 7

Results of JASO T903:2016 test using SAE no. 2 machine

| Sample | SFI | % SFI decrease |
|---|---|---|
| 1-control | 2.35 | N/A |
| 2 | 2.12 | 10 |
| 3 | 2.09 | 11 |
| 4 | 1.67 | 29 |
| 5-comp | 1.53 | 35 |

It can be seen from Table 7 that when using an SAE no. 2 friction test machine, inventive Samples 2 to 4 have a smaller decrease in SFI when compared with comparative Sample 5. A smaller decrease is a more favourable result in this test since a higher SFI is desirable.

The static friction index (SFI), dynamic friction index (DFI), and stop time index (STI) were calculated according to the JASO T903 standard. The overall JASO rating was also calculated using Table 9 below. The results are given in Table 8.

TABLE 8

JASO indices and overall rating

| Sample | SFI | DFI | STI | Overall JASO rating |
|---|---|---|---|---|
| 1-control | 2.35 (MA2) | 1.98 (MA2) | 2.01 (MA2) | MA2 |
| 2 | 2.12 (MA2) | 1.98 (MA2) | 2.02 (MA2) | MA2 |
| 3 | 2.09 (MA2) | 2.00 (MA2) | 1.98 (MA2) | MA2 |
| 4 | 1.67 (MA2) | 1.91 (MA2) | 1.93 (MA2) | MA2 |
| 5-comp | 1.53 (MA1) | 1.92 (MA2) | 1.89 (MA2) | MA |

It can be seen from Table 8 that inventive Samples 2 to 4 maintain the same highest overall JASO rating of MA2 when compared with control Sample 1. In contrast, the glycerol monoisostearate (GMIS) has reduced the JASO rating of comparative Sample 5 from MA2 to MA due to its lower SFI value.

The overall JASO rating is determined by comparing the value of individual friction indices to thresholds defined by the JASO T903:2016 standard. These thresholds are given in Table 9. A sample or oil is essentially rated on its lowest friction property, for example if a sample has DFI and STI at MA2, but SFI is MB then the sample is rated overall as MB. If all three properties of a JASO MA oil fall within the limits specified as MA1 then the oil is rated as a JASO MA1 oil. If all its properties fall within the limits of MA2 then it is rated as a JASO MA2 oil. If some properties fall within the MA1 subcategory but others in MA2 then the product is simply a JASO MA product.

TABLE 9

Thresholds for the friction properties and associated JASO ratings.

| Friction index | MB | MA1 | MA2 | MA |
|---|---|---|---|---|
| SFI | 0.40-1.44 | 1.45-1.59 | 1.60-2.50 | 1.45-2.50 |
| DFI | 0.40-1.34 | 1.35-1.49 | 1.50-2.50 | 1.35-2.50 |
| STI | 0.40-1.39 | 1.40-1.59 | 1.60-2.50 | 1.40-2.50 |

It is to be understood that the invention is not to be limited to the details of the above embodiments, which are described by way of example only. Many variations are possible.

The invention claimed is:

1. A lubricant formulation comprising:

(a) a base oil selected from API Group I to V oils and mixtures thereof; and (b) a friction modifier additive present in a range of from 0.01 to 10 wt % on the basis of the total weight of the lubricant formulation wherein the friction modifier additive has a hydroxyl value in the range from 10 to 300 mg KOH/g when measured according to ASTM D1957-86 and the friction modifier additive is the reaction product of reactants comprising:

i) a dimer fatty acid;

ii) a polyol selected from ethylene glycol, diethylene glycol, triethylene glycol, polyethylene glycol, propylene glycol, dipropylene glycol, tripropylene glycol polypropylene glycol, butylene glycol, propanediol, butanediol, glycerol and mixtures thereof; and one or both of:

iii) a C2 to C12 aliphatic dicarboxylic acid or diol; and iv) a C1 to C10 aliphatic mono-carboxylic acid or mono-alcohol.

2. The lubricant formulation of claim 1, wherein reactant ii) of the friction modifier additive is a polyol selected from ethylene glycol, diethylene glycol, triethylene glycol, propylene glycol, dipropylene glycol, tripropylene glycol and mixtures thereof.

3. The lubricant formulation of claim 1, wherein the friction modifier additive comprises:

iii) the C2 to C12 aliphatic dicarboxylic acid.

4. The lubricant formulation of claim 1, wherein the friction modifier additive comprises:

iv) the C1 to C10 aliphatic mono-alcohol.

5. The lubricant formulation of claim 1, wherein the friction modifier is present in a range of from 0.1 to 6 wt %, relative to the total weight of the lubricant formulation.

6. The lubricant formulation of claim 1, wherein the lubricant formulation is a motorcycle oil further comprising other lubricant formulation additives as part of a motorcycle oil additive pack.

7. The lubricant formulation of claim 1, wherein the lubricant formulation comprises at most 0.01 wt % (100 ppm) of molybdenum atoms in total when all molybdenum containing additives in the lubricant formulation are considered.

8. The lubricant formulation of claim 1, which has an overall grade of MA, MA1 or MA2 as defined by JASO standard T903.

9. The lubricant formulation of claim 8, which has an overall grade of MA2 as defined by JASO standard T903.

10. A method of lubricating an internal combustion engine comprising a crankcase and a wet clutch, the method comprising supplying a lubricant formulation of claim 1 to the crankcase and the wet clutch.

11. The method of claim 10, wherein the lubricant formulation is formulated to provide beneficial frictional effects to both a gear in the crankcase and the wet clutch of the internal combustion engine, wherein the beneficial frictional effect comprises:

(a) reducing the dynamic coefficient of friction (DCF), when measured according to MTM Test 1 by at least 10% when measured according to MTM Test 1 at speeds of 0.005 $ms^{-1}$, 0.05 $ms^{-1}$, 0.5 $ms^{-1}$, and/or 3 $ms^{-1}$, and/or (b) reducing the static friction index (SFI), as measured according to the JASO T903:2016 standard, by less than 35%, when compared to an otherwise identical lubricant formulation that does not contain the friction modifier additive that is the reaction product of reactants comprising:

i) the dimer fatty acid;

ii) the polyol; and the one or both of:

iii) the C2 to C12 aliphatic dicarboxylic acid or diol; and iv) the C1 to C10 aliphatic mono-carboxylic acid or mono-alcohol.

12. The method of claim 10, wherein the lubricant formulation is further supplied to a gear.

13. The method of claim 10, wherein the lubricant formulation is supplied from a single lubricant reservoir.

14. The method of claim 10, wherein the internal combustion engine is a 4-stroke engine.

15. The method of claim 10, wherein the internal combustion engine is a motorcycle engine.

16. The lubricant formulation of claim 1, wherein the friction modifier additive has a hydroxyl value in the range from 15 to 140 mg KOH/g when measured according to ASTM D1957-86.

17. The lubricant formulation of claim 1, wherein the friction modifier additive has an acid value in a range of from 0.01 to 2.5 mg KOH/g when measured according to ASTM D1980-87.

18. The lubricant formulation of claim 1, formulated to provide beneficial frictional effects to both a gear and a wet clutch in an internal combustion engine comprising the wet clutch and a crankcase housing the gear, wherein the beneficial frictional effect comprises:

(a) reducing the dynamic coefficient of friction (DCF) by at least 10%, when measured according to MTM Test 1 at speeds of 0.005 $ms^{-1}$, 0.05 $ms^{-1}$, 0.5 $ms^{-1}$, and/or 3 $ms^{-1}$, and/or (b) reducing the static friction index (SFI), as measured according to the JASO T903:2016 standard, by less than 35%, when compared to an otherwise identical lubricant formulation that does not contain the friction modifier additive that is the reaction product of reactants comprising:

i) the dimer fatty acid;

ii) the polyol; and the one or both of:

iii) the C2 to C12 aliphatic dicarboxylic acid or diol; and iv) the C1 to C10 aliphatic mono-carboxylic acid or mono-alcohol.

19. The lubricant formulation of claim 3, wherein the dimer acid and the C2 to C12 aliphatic dicarboxylic acid are present in the friction modifier additive in a weight ratio of from 6:1 to 1:6.

20. The lubricant formulation of claim 3, wherein the C2 to C12 aliphatic dicarboxylic acid is adipic acid.

21. The lubricant formulation of claim 4, wherein the dimer acid and the C1 to C10 aliphatic mono-alcohol are present in the friction modifier additive in a weight ratio of from 2:1 to 1:2.

22. The lubricant formulation of claim 4, wherein the C1 to C10 aliphatic mono-alcohol is ethyl hexanol.

23. A 4-stroke (piston) engine comprising the lubricant formulation of claim 1.

24. The 4-stroke (piston) engine of claim 21 having a capacity up to a 3500 $cm^3$ displacement.

* * * * *